US007096606B2

(12) United States Patent
Lai Fu

(10) Patent No.: US 7,096,606 B2
(45) Date of Patent: Aug. 29, 2006

(54) SHOE WITH A DECORATIVE SHOWCASE

(76) Inventor: Chiu-Hsiang Lai Fu, No. 118, Sec. 1, Changlung Road, Taiping City, Taichung Hsien (TW)

( * ) Notice: Subject to any disclaimer, the term of this patent is extended or adjusted under 35 U.S.C. 154(b) by 198 days.

(21) Appl. No.: 10/752,539

(22) Filed: Jan. 8, 2004

(65) Prior Publication Data

US 2005/0150136 A1 Jul. 14, 2005

(51) Int. Cl.
*A43B 23/24* (2006.01)

(52) U.S. Cl. ..... 36/136; 36/1; 36/15

(58) Field of Classification Search ..... 36/1, 36/112, 136, 15, 41, 42
See application file for complete search history.

(56) References Cited

U.S. PATENT DOCUMENTS 2,759,284 A * 8/1956 Santisi ..... 36/11.5
2,889,639 A * 6/1959 Rudine ..... 36/25 R
3,664,041 A * 5/1972 Frattallone ..... 36/42
4,363,177 A * 12/1982 Boros ..... 36/101
4,834,688 A * 5/1989 Jones ..... 446/28
5,256,457 A * 10/1993 Pantaleo et al. ..... 428/13
5,379,533 A * 1/1995 Swartz ..... 36/136
D392,791 S * 3/1998 Ng ..... D2/900
5,815,950 A * 10/1998 Wang ..... 36/29
5,822,885 A * 10/1998 Loverin ..... 36/25 R
5,839,211 A * 11/1998 Pallera ..... 36/136
6,253,945 B1 * 7/2001 Lee ..... 220/23.86
2004/0114353 A1 * 6/2004 Romeo ..... 362/103

* cited by examiner

*Primary Examiner*—Marie Patterson
(74) *Attorney, Agent, or Firm*—Fei-Fei Chao; Andrews Kurth LLP

(57) ABSTRACT

A shoe with a decorative showcase has a shoe body and transparent case selectively attached to a position on the shoe body. The transparent case contains at least one kind of liquid and multiple floating objects in different shapes floating on the at least one kind of liquid. Thereby, the transparent case imitates objects such as flowers or ducklings floating on water to provide a novel and revolutionarily attractive to the shoe.

10 Claims, 6 Drawing Sheets

SHOE WITH A DECORATIVE SHOWCASE

BACKGROUND OF THE INVENTION

1. Field of the Invention

The invention relates to a shoe with a decorative showcase, and particularly to a showcase containing at least one kind of liquid and multiple floating objects built into or detachably mounted in the shoe.

2. Description of Related Art

A conventional shoe in accordance with the prior art basically comprises an outsole, an insole bonded to the outsole and an shoe upper attached to the outsole to accommodate a foot inside the shoe. Although shoes have various shapes and are modified according to their different functions, shoes still can not get rid of conventional style to create a new and novel appearance. Conventional shoe styles have shown virtually no revolutionary creativity in present times.

The present invention has arisen to provide a shoe with a decorative showcase to make the shoe to have an innovative and attractive appearance.

SUMMARY OF THE INVENTION

A main objective of the present invention is to provide a shoe with a decorative showcase that contains at least one kind of liquid and multiple floating objects inside to make the shoe interesting.

Further benefits and advantages of the present invention will become apparent after a careful reading of the detailed description in accordance with the drawings.

DETAILED DESCRIPTION OF THE PREFERRED EMBODIMENT

A shoe with a decorative showcase in accordance with the present invention comprises a shoe body and a transparent case. The shoe body has an outsole and an upper. The transparent case is attached to the shoe body and contains at least one kind of liquid and multiple floating objects to enhance the shoe's appearance and attractiveness.

Figure 1:
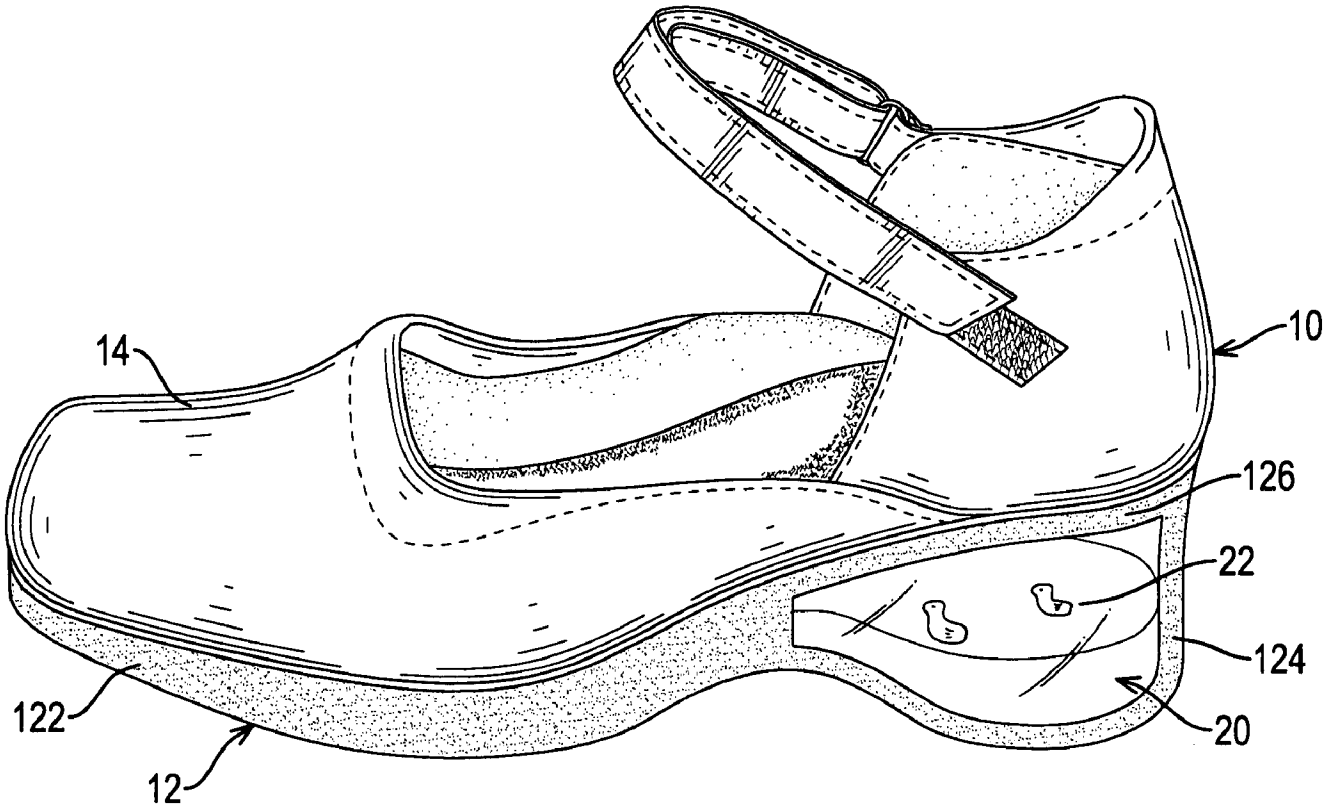
FIG. 1 is a perspective view of a first embodiment of a shoe with a decorative showcase in accordance with the present invention with the showcase in a heel portion of an outsole.

With reference to FIG. 1, a preferred embodiment of a shoe with a decorative showcase in accordance with the present invention comprises a shoe body (10) and a transparent case (20). The shoe body (10) has an outsole (12) and an upper (14) mounted on the outsole (12). The outsole (12) is transparent and has a front portion (122), a rear portion (126) and a heel portion (124) extending from the rear portion (126).

The transparent case (20) is selectively embedded inside the outsole, is integrally built-in at the heel portion (124) of the outsole (12) and contains only one kind of liquid. Multiple duck-shaped floating objects (22) float on the liquid to simulate ducklings swimming on a lake. Preferably, the liquid is dyed green or blue. Additionally, each of the duck-shaped floating objects (22) has a bottom (not shown) and contains a weight (not shown) embedded in the bottom to keep the floating object upright.

Figure 2:
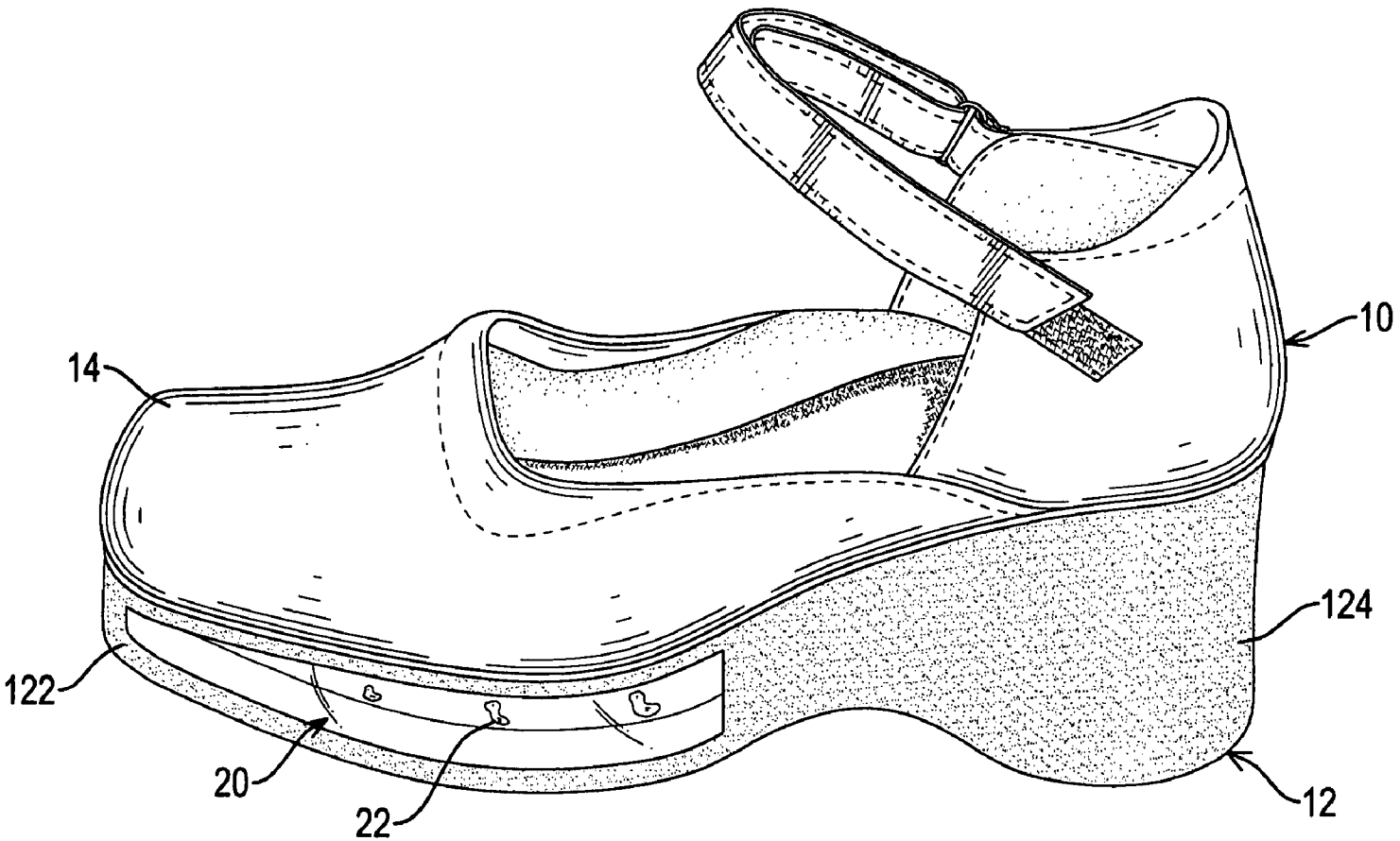
FIG. 2 is a perspective view of a second embodiment of a shoe with a decorative showcase in accordance with the present invention with the decorative showcase in a front portion of an outsole.

With reference to FIG. 2, the transparent case (20) in a second embodiment of a shoe with a decorative showcase in accordance with the present invention is a long thin shape and is selectively and integrally built into the front portion (122) of the outsole (12).

Figure 3:
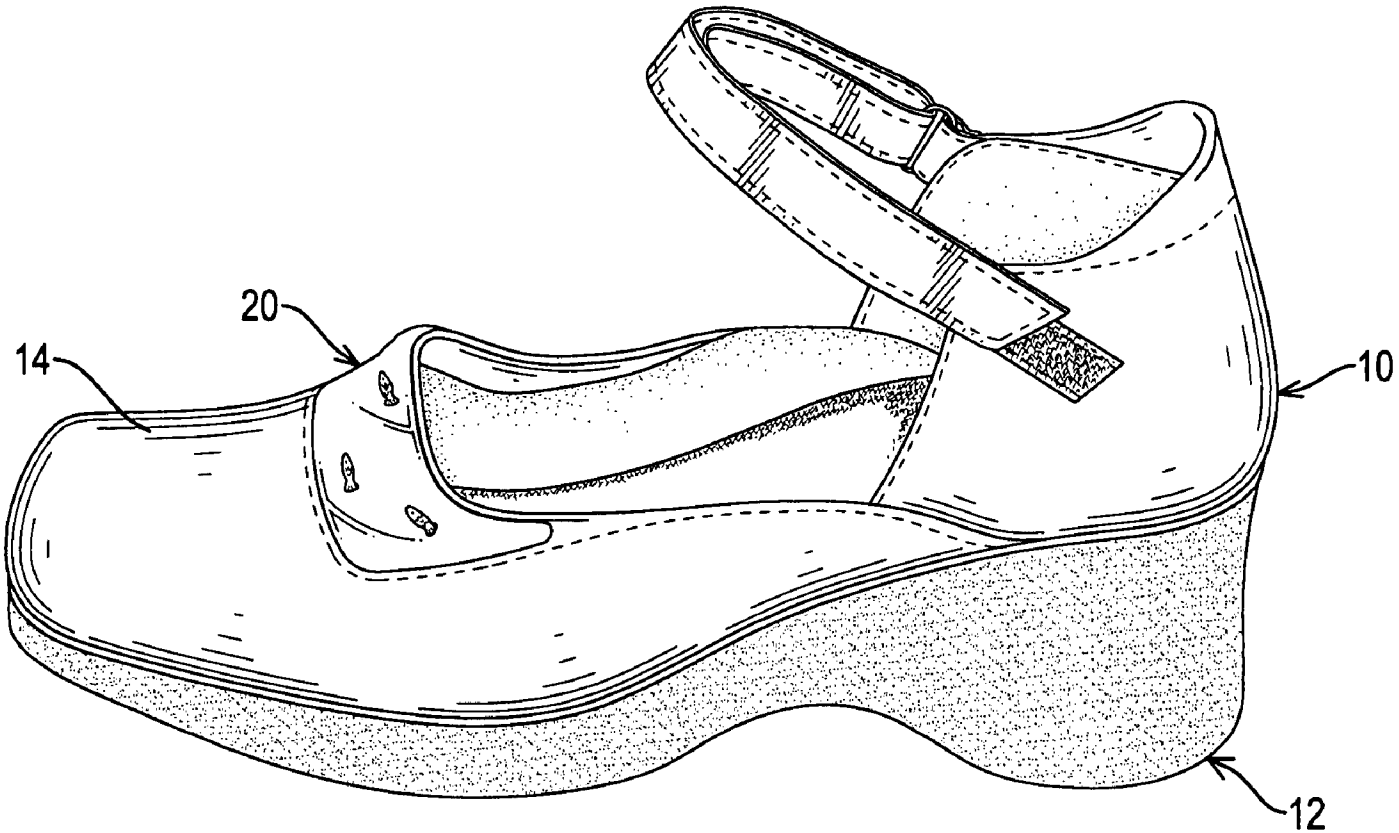
FIG. 3 is a perspective view of a third embodiment of a shoe with a decorative showcase in accordance with the present invention with the decorative showcase mounted on an upper.

With reference to FIG. 3, the transparent case (20) in a third embodiment of a shoe with a decorative showcase in accordance with the present invention is an elongated flat shape to attached on the upper (14) of the shoe.

Figure 4:
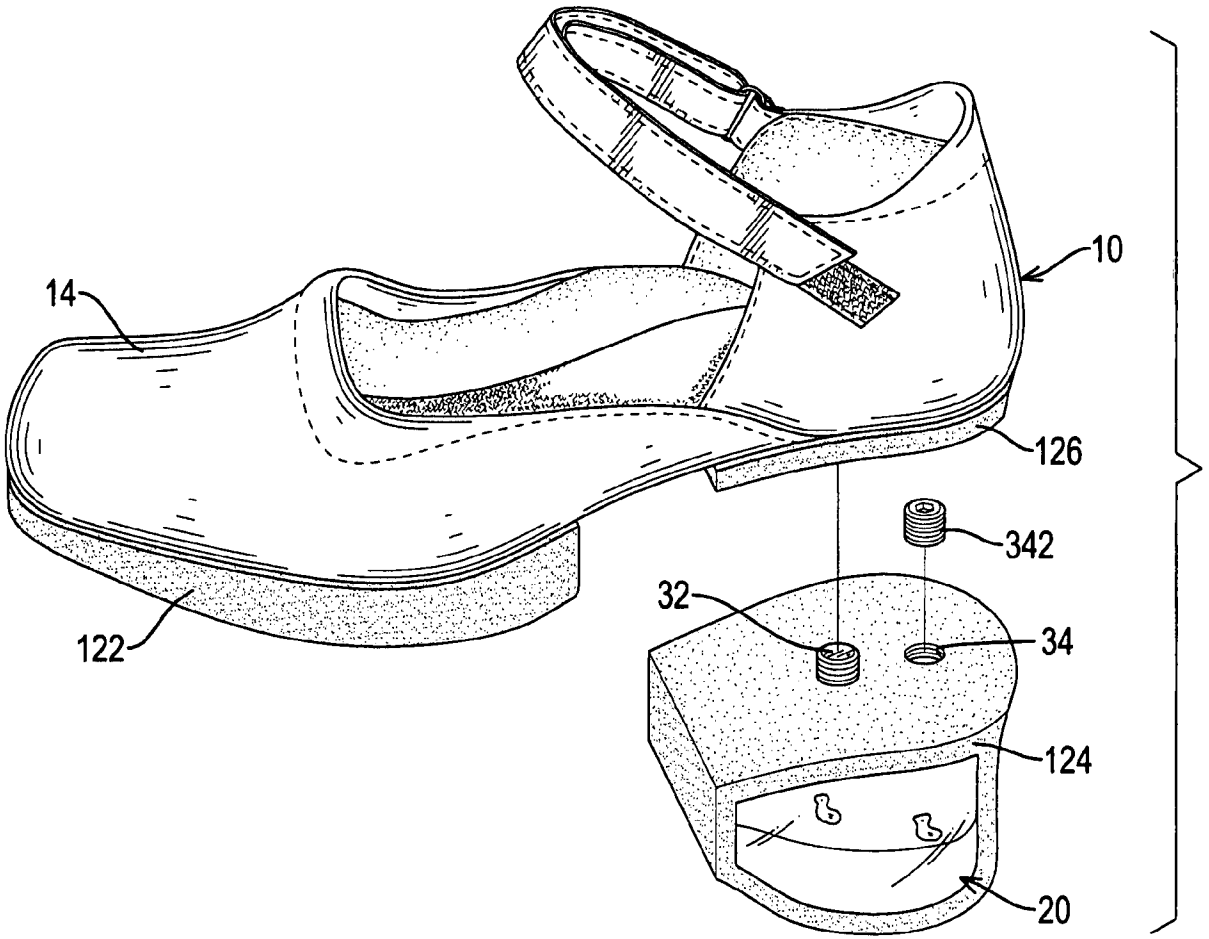
FIG. 4 is a perspective view of a fourth embodiment of a shoe with a decorative showcase in accordance with the present invention with the decorative showcase detachably mounted on a heel portion of the outsole.

With reference to FIG. 4, the heel portion (124) in a fourth embodiment of a shoe with a decorative showcase in accordance with the present invention is detachably mounted on the rear portion (126), and the transparent case (20) is embedded inside the heel portion (124). The heel portion (124) further has a top flat face (not numbered), a threaded connecting rod (32), an optional injecting hole (34) and an optional plug (342). The threaded connecting rod (32) is mounted on the top flat face to screw into the outsole (12) and connects the heel portion (124) with the transparent case (20) to the rear portion (126). The optional injecting hole (34) is threaded and is defined through the top face of the heel portion (124) to communicate with the transparent case (20) and to allow liquid to be injected into the transparent case (20) through the injecting hole (34). When the optional injecting hole (34) is defined in the heel portion (124), the optional plug (342) screws into the injecting hole (34) to close and seal the transparent case (20).

Figure 5:
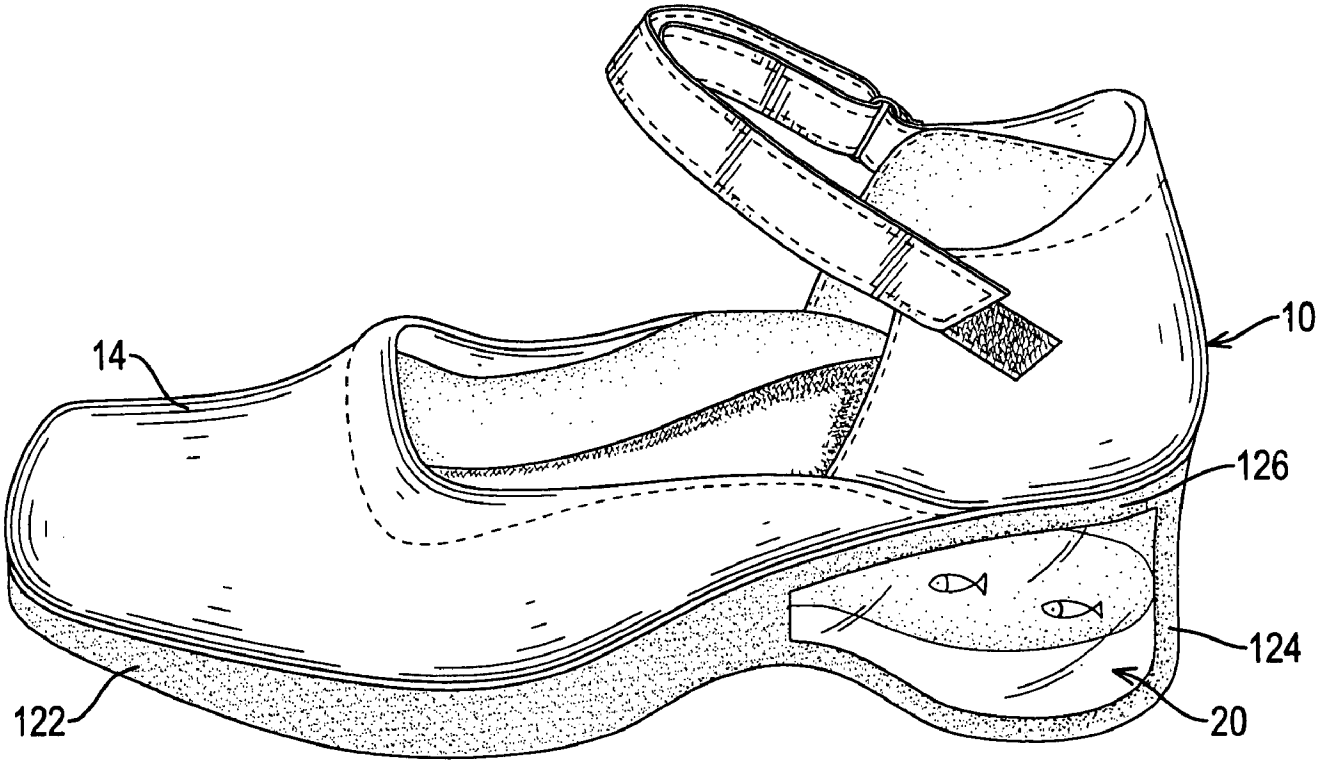
FIG. 5 is a perspective view of a fifth embodiment of a shoe with a decorative showcase in accordance with the present invention with the decorative showcase containing two different liquids respectively having a different specific gravity.

With reference to FIG. 5, the transparent case (20) in a fifth embodiment of a shoe with a decorative showcase in accordance with the present invention selectively contains two kinds of liquids respectively having a different specific gravity and color. The two kinds of liquids are immiscible and form two distinct layers (not numbered) in the transparent case (20). The multiple floating objects (22) are weighted to float upright at the boundary between the two distinct layers. The two kinds of liquids may be an oil (specific gravity: 0.8) and water (specific gravity: 1), and the floating objects (22) may be fish shapes.

Figure 6:
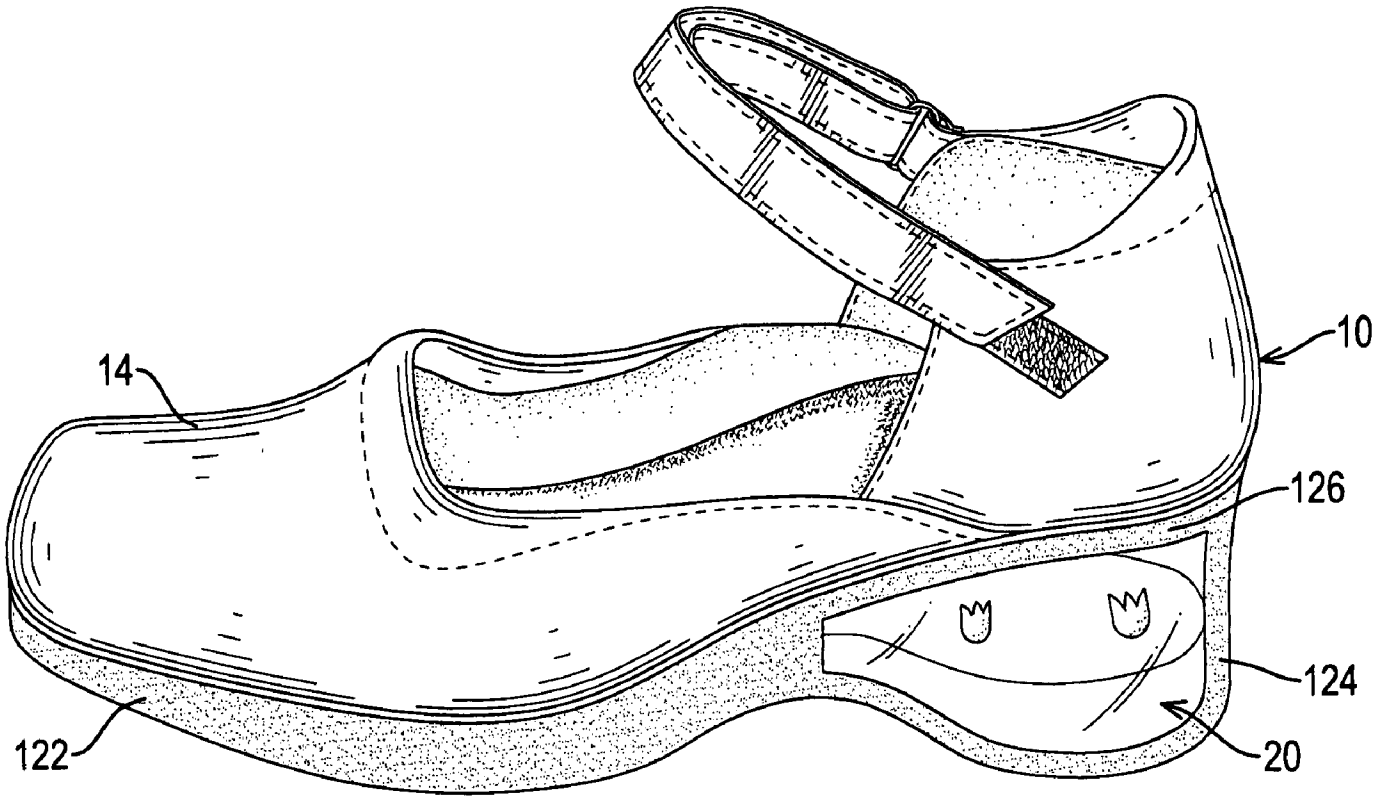
FIG. 6 is a perspective view of a sixth embodiment of a shoe with a decorative showcase in accordance with the present invention with the decorative showcase containing different floating objects in flower shapes.

With reference to FIG. 6, the multiple floating objects (22) in a sixth embodiment of a shoe with a decorative showcase in accordance with the present invention are selectively flowers shapes The shoe with a decorative showcase has an interesting and revolutionary appearance to imitate objects on floating liquids so that the shoe is attractive to people.

Although the invention has been explained in relation to its preferred embodiment, many other possible modifications and variations can be made without departing from the spirit and scope of the invention as hereinafter claimed.

What is claimed is:

1. A shoe with a decorative showcase, the shoe comprising:

a shoe body (10) having an outsole (12) and an upper (14) mounted on the outsole (12), wherein the outsole (12) has a front portion (122), a rear portion (126) and a heel portion (124) detachably mounted on the rear portion (126) and having a top flat face, a threaded connecting rod (32) extending from the top flat face to screw into the rear portion (126) of the outsole (12), an injection hole (34) being threaded and defined through the top flat face to communicate with the transparent case (20), and a plug (342) screwed into the injection hole (34); and a transparent case (20) attached to the shoe body (10) and containing at least two kinds of liquids respectively with a different specific gravity and being immiscible and multiple floating objects (22) floating on one of the at least two kinds of liquids.

2. The shoe as claimed in claim 1, wherein the transparent case (20) is attached to the upper (14).

3. The shoe as claimed in claim 1, wherein the transparent case (20) comprises two kinds of liquids.

4. The shoe as claimed in claim 3, wherein the at least two kinds of the liquids respectively have different colors.

5. The shoe as claimed in claim 4, wherein the two kinds of liquids are oil and water.

6. The shoe as claimed in claim 1, wherein the at least two kinds of the liquids respectively have different colors.

7. The shoe as claimed in claim 6, wherein the two kinds of liquids are oil and water.

8. The shoe as claimed in claim 1, wherein the multiple floating objects are shaped as ducklings.

9. The shoe as claimed in claim 1, wherein the multiple floating objects are shaped as fishes.

10. The shoe as claimed in claim 1, wherein the multiple floating objects are shaped as flowers.

* * * * *